United States Patent [19]

Wright et al.

[11] Patent Number: 5,005,232

[45] Date of Patent: Apr. 9, 1991

[54] PATIENT SHIFTER PAD

[75] Inventors: H. Earl Wright; Brad E. Wright, both of Decatur, Ill.

[73] Assignee: Inventive Products, Inc., Decatur, Ill.

[21] Appl. No.: 561,188

[22] Filed: Aug. 1, 1990

[51] Int. Cl.[5] ..... A61G 7/08

[52] U.S. Cl. ..... 5/81 C; 5/81 R

[58] Field of Search ..... 5/81 R, 81 B, 81 C, 5/449

[56] References Cited

U.S. PATENT DOCUMENTS

| | | | |
|---|---|---|---|
| 2,528,048 | 10/1950 | Gilleland | 5/86 |
| 2,694,396 | 11/1954 | Paschal | 128/67 |
| 2,918,681 | 12/1959 | Davis | 5/81 |
| 3,769,642 | 11/1973 | Warman | 5/81 A |
| 3,849,813 | 11/1974 | Neilson | 5/81 R |
| 4,051,565 | 10/1977 | Berge | 5/81 B |
| 4,067,079 | 1/1978 | Buchman | 5/81 R |
| 4,084,275 | 4/1978 | Ilon | 5/81 R |
| 4,104,425 | 8/1978 | Hirmann | 5/81 R |
| 4,657,021 | 4/1987 | Perry et al. | 128/630 |
| 4,716,607 | 1/1988 | Johansson | 5/81 B |
| 4,744,115 | 5/1988 | Marchione | 5/81 B |
| 4,793,354 | 12/1988 | Wright et al. | 128/630 |
| 4,944,053 | 7/1990 | Smith | 5/81 B |

FOREIGN PATENT DOCUMENTS

| | | | |
|---|---|---|---|
| 95325 | 11/1983 | European Pat. Off. | 5/81 R |
| 645391 | 5/1937 | Fed. Rep. of Germany . | |

*Primary Examiner*—Gary L. Smith
*Assistant Examiner*—F. Saether
*Attorney, Agent, or Firm*—Samuels, Miller, Schroeder, Jackson & Sly

[57] ABSTRACT

A pad is used in shifting a patient from one bed, or other horizontal surface, to another. The pad is formed of a sealed, elongated, and flattened enclosure of a flexible, puncture-resistant material and contains, sealed within the enclosure, a lubricant to reduce the friction between the inside surfaces of the enclosure.

5 Claims, 1 Drawing Sheet

PATIENT SHIFTER PAD

FIELD OF THE INVENTION

This invention relates to a device which facilitates the transfer of a person from one bed, or other horizontal surface, to another.

BACKGROUND OF THE INVENTION

It is often necessary to transfer a person from one bed, or other horizontal surface, to another. The person being transferred is typically an invalid, a patient, or someone else who is physically incapable of moving himself. The transfer typically occurs at a hospital, nursing home, or other care facility as the person is moved between beds, gurneys, operating tables, and other horizontal platforms. Accomplishing this type of transfer is not an easy task. In hospitals, it is common for six or more nurses to be required to transfer a patient from a hospital bed to a gurney. Nevertheless, the most common job-related injury suffered by nurses are back injuries incurred during a patient transfer.

Several devices have been disclosed to help with such transfers. For example, devices containing internal rollers are disclosed in Gilleland, U.S. Pat. No. 2,528,048, issued Oct. 31, 1950, and Davis, U.S. Pat. No. 2,918,681, issued Dec. 29, 1959. The Gilleland device is a wheeled stretcher containing rollers and winding means. The stretcher is used only for transferring patients to or from the stretcher. The Davis device, in contrast, is capable of use in transfers between any two platforms. It is a rigid, flat, rectangular device containing rollers and a track of an endless belt of heavy material such as canvas. The device is placed into a position straddling the bed containing the patient and the bed to which the patient is being moved. The patient is shifted onto the device and then rolled onto the second bed.

A second class of patient shifters are those consisting of mats having low friction surfaces on one side. Such mats are disclosed in Warman, U.S. Pat. No. 3,769,642, issued Nov. 6, 1973, and Berge, U.S. Pat. No. 4,051,565, issued Oct. 4, 1977. Warman discloses a rectangular sheet having a high friction surface on one side and a low friction surface on the other side. The sheet is partially folded over with the low friction surfaces facing each other. The patient is then rolled on top of the folded-over portion and the sheet is pulled to move the patient. A second embodiment disclosed in FIG. 5 of Warman contains the same type of sheet except the longitudinal ends are connected together to form an open-ended tube. The tube is open-ended to enable it to rotate upon itself. A third embodiment disclosed in FIGS. 6 through 8 consists of the tube plus a second sheet which is attached along a seam dividing the second sheet into two substantially-equal portions. Berge discloses an open-ended tubelike mat having an interior layer of a relatively friction-free material and an exterior layer of a foam-type material. The Berge mat is placed in a position straddling the two beds and the patient is then pushed or pulled across the mat. The mat is free to rotate upon itself because of its open ends.

Smaller devices intended for massaging or touch enhancement and which consist of sealed enclosures of flexible materials containing lubricant on the inside are disclosed in Beck, German Pat. No. 645,391, published May 26, 1937; Paschal, U.S. Pat. No. 2,694,396, issued Nov. 16, 1954; Perry et al., U.S. Pat. No. 4,657,021, issued Apr. 14, 1987; and Wright et al., U.S. Pat. No. 4,793,354, issued Dec. 27, 1988.

Despite the number of patient shifting devices which have been disclosed, none is apparently enjoying commercial success and a need exists for an effective device which is lightweight, inexpensive, simple to use, and easy to store.

SUMMARY OF THE INVENTION

The object of this invention is to provide an improved device for use in shifting patients.

We have discovered a pad for use in shifting a patient from one bed, or other horizontal surface, to another. The pad comprises: (a) a sealed, elongated, and flattened enclosure of a flexible puncture-resistant material having sufficient size to support a patient, having substantially parallel longitudinal sides, and having end sides forming an angle of greater than 90° to the longitudinal sides to ease the rotation of the enclosure over upon itself when a patient is placed on top of the pad and shifted; and (b) a lubricant sealed within the enclosure to reduce the friction between the inside surfaces of the enclosure to further ease the rotation of the enclosure over upon itself when a patient is placed on top of the pad and shifted laterally.

This patient shifter pad is lightweight, inexpensive, simple to use, foldable for easy storage, and very effective in facilitating the transfer of patients. Where six or more nurses might struggle to transfer a heavy patient without this pad, two nurses can easily accomplish the same transfer using the pad.

DETAILED DESCRIPTION OF THE INVENTION

Figure 1:
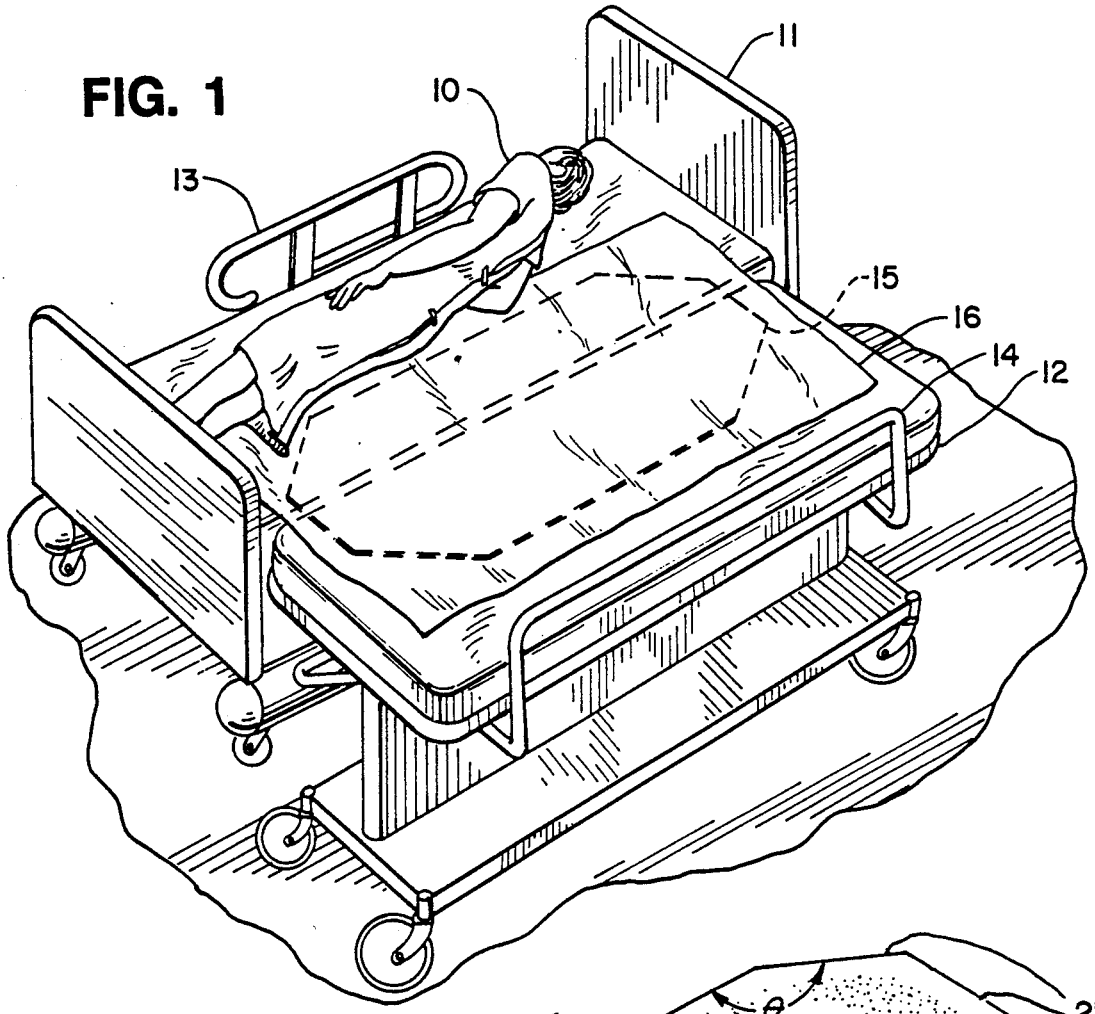
FIG. 1 is a perspective view of a patient about to be transferred from a hospital bed to a gurney using the patient shifter pad of this invention.

The use of the patient shifter pad of this invention is illustrated in FIG. 1. A patient 10 is to be transferred from hospital bed 11 to gurney 12. The gurney is positioned alongside the hospital bed and the two are secured together using the customary locking means (not shown) forming a part of the gurney. The rail 13 of the hospital bed opposite the gurney is raised for safety, as is the rail 14 of the gurney opposite the hospital bed. The patient is rolled onto his side facing away from the gurney, as shown. The patient shifter pad 15 is then placed in position straddling the bed and gurney. Although not a requirement, it is preferred to then place a sheet 16 on top of the patient shifter pad.

The patient is then rolled back onto his back and onto the sheet. One person can then pull the sheet toward the gurney from the gurney side while a second person pushes the patient in the same direction from the side of the hospital bed. The patient shifter pad reduces friction and makes this transfer relatively easy for two persons, even with heavy patients weighing 200 pounds or more.

Figure 2:
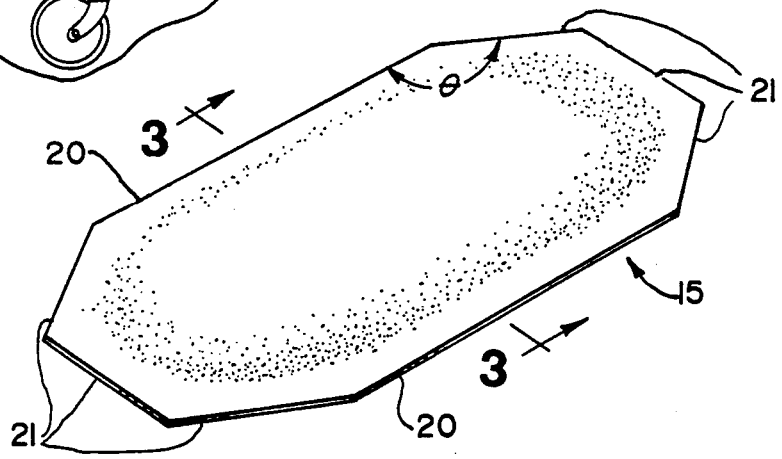
FIG. 2 is a perspective view of the patient shifter pad.
Figure 3:
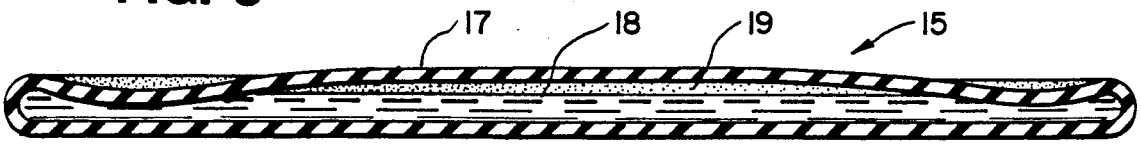
FIG. 3 is a sectional view of the patient shifter pad taken on line 3—3 of FIG. 2.

After the patient has been shifted to the gurney, he is rolled onto his side facing away from the bed to free the pad and sheet. Both are removed and the patient is then rolled back onto his back and the gurney is separated from the hospital bed. FIG. 2 shows the pad itself and FIG. 3 is a cross-sectional view of the pad showing the enclosure 17, a liquid lubricant 18, and a volume of air 19.

From the foregoing, it can be readily seen that the patient shifter pad has sufficient size to support a patient. At the minimum, the pad is large enough to support the patient's torso, where the majority of weight is located. In general, the pad is about 5 to 7 feet long and about 2 to 4 feet wide.

The pad turns over upon itself while in use and its shape facilitates this movement. As shown in FIG. 2, its longitudinal sides 20 are substantially parallel. Its end sides 21 form an angle of greater than 90° to the longitudinal sides, preferably greater than about 120°. As shown in FIG. 2, this angle $\theta$ is about 135°. As this angle approaches 90°, the end sides of the pad begin to resist rotation and interfere with the use of the pad. The end sides of the pad can be shaped trapezoidal, as shown in FIG. 2, or can be shaped semi-circular, pyramidal, or the like.

The pad is formed of a flexible, puncture-resistant material. The material has a tensile strength greater than about 3,000 psi and preferably greater than about 5,000 psi. It has a thickness of about 0.005 to 0.03 inches and preferably about 0.01 to 0.02 inches. The material is resistant to germicides, including those containing chlorine, because such cleaners are often used in medical care facilities. The material is also resistant to the flow of air. The material has a uniformly smooth surface on at least one side so that movement of one layer across the other layer is facilitated. The material is sealable with heat, radio-frequency electromagnetic radiation ('RF'), and/or adhesives.

Materials exhibiting the above-described properties of flexibility, tensile-strength, thickness, smoothness, and sealability are generally members of the class of polymers known as elastomers. Both synthetic and natural elastomers are suitable. Synthetic elastomers include certain polychloroprene polymers, butadiene-styrene copolymers, butadiene-acrylonitrile copolymers, and polyurethane polymers. A preferred class of sYnthetic elastomers are the polyurethanes.

To facilitate rotation of the pad, it is preferred that the number of seams are minimized. Some elastomeric materials are available in the form of tubes having sufficient diameter so that they can be used for the enclosure by making the desired cuts at the end and thus avoiding any longitudinal seams. However, the more common method of forming the enclosure is to cut two separate pieces of material and to seal them together along the edges.

As shown in FIG. 3, a lubricant is sealed within the enclosure to reduce friction between the interior surfaces of the enclosure. The reduction of friction facilitates rotation of the pad over upon itself. The lubricant generally has sufficient lubricity to reduce the coefficient of kinetic friction between the layers by at least about 50 percent. The lubricant also reduces the coefficient of static friction sufficiently to prevent 'lock-out' when a heavy person is on the pad, i.e., lateral movement can be begun regardless of the downward force. It is preferred that the lubricant is a liquid with a sufficiently low viscosity to flow readily so that only a relatively small quantity is needed to fully coat the interior of the enclosure. Suitable lubricants include mixtures of water and soap, glycerine, propylene glycol, polyoxyethylene (also known as polyethylene glycol), and silicone-based liquid lubricants such as polydimethylsiloxane. A preferred lubricant is Organosilicone Fluid L-45, a polydimethylsiloxane fluid which is a commercial product of the Union Carbide Corporation, Danbury, Conn.

The lubricant is present in a quantity sufficient to fully coat the interior of the enclosure and yet still permit the enclosure to be flattened with at least about 75 percent of the surface area of one side in contact with the other side. For example, about 300 ml of Organosilicone Fluid L-45 is used with a 6 foot by 3 foot enclosure of polyurethane.

The ease with which the patient shifter pad rotates is improved somewhat if a volume of gas is also present inside the enclosure. The gas has substantial inertness towards the enclosure. Air is the preferred gas for ease of manufacture. The volume of gas is generally about double the volume of liquid lubricant.

We claim:

1. A pad for use in shifting patient from one bed, or other horizontal surface, to another, the pad comprising:

(a) a sealed, elongated, and flattened enclosure of a flexible puncture-resistant material having sufficient size to support a patient, having substantially parallel longitudinal sides, and having end sides forming an angle of greater than 90° to the longitudinal sides to ease the rotation of the enclosure over upon itself when a patient is placed on top of the pad and shifted; and (b) a lubricant sealed within the enclosure to reduce the friction between the inside surfaces of the enclosure to further ease the rotation of the enclosure over upon itself when a patient is placed on top of the pad and shifted laterally.

2. The pad of claim 1 wherein the enclosure has a length of about 5 to 7 feet, a width of about 2 to 4 feet, and end sides forming an angle of greater than about 120° to the longitudinal sides.

3. The pad of claim 2 wherein the enclosure material has a tensile strength greater than about 3,000 psi and a thickness of about 0.005 to 0.03 inches.

4. The pad of claim 3 wherein the lubricant is selected from the group consisting of water and soap, glycerine, propylene glycol, polyoxyethylene, and silicone-based liquid lubricants.

5. The pad of claim 4 additionally comprising a volume of gas sealed within the enclosure.

* * * * *